US006925743B1

(12) United States Patent
DiGiovanna

(10) Patent No.: US 6,925,743 B1
(45) Date of Patent: Aug. 9, 2005

(54) TACTICAL DUO STOCK

(76) Inventor: Thomas DiGiovanna, 2033 S. Welling Rd., Welling, OK (US) 74471

( * ) Notice: Subject to any disclaimer, the term of this patent is extended or adjusted under 35 U.S.C. 154(b) by 0 days.

(21) Appl. No.: 10/288,999

(22) Filed: Nov. 6, 2002

(51) Int. Cl.[7] ..... F41C 23/00
(52) U.S. Cl. ..... 42/71.01; 42/74
(58) Field of Search ..... 42/71.01, 72, 74

(56) References Cited

U.S. PATENT DOCUMENTS

| | | | | |
|---|---|---|---|---|
| 146,651 A | | 1/1874 | Byrkit | |
| 476,246 A | * | 6/1892 | Burgess | 42/21 |
| 694,904 A | | 3/1902 | Youlten | |
| 843,227 A | | 2/1907 | Munson | |
| 855,229 A | | 5/1907 | Clarisey | |
| 1,088,362 A | | 2/1914 | Perkins | |
| 1,582,395 A | | 4/1926 | Haemmerli | |
| 1,651,299 A | | 11/1927 | Stansel | |
| D85,338 S | | 10/1931 | Kres | |
| 1,951,135 A | * | 3/1934 | Emswiler | 42/74 |
| 2,437,548 A | | 11/1948 | Patchett | |
| 3,798,819 A | * | 3/1974 | Hillberg | 42/72 |
| 3,939,589 A | | 2/1976 | Tellie | |
| 4,316,342 A | * | 2/1982 | Griggs | 42/74 |
| 4,663,876 A | * | 5/1987 | Reaume | 42/71.01 |
| 4,887,374 A | * | 12/1989 | Santarossa | 42/73 |
| 4,982,521 A | * | 1/1991 | Sutton et al. | 42/74 |
| 5,001,855 A | * | 3/1991 | Griggs | 42/74 |
| 5,010,676 A | * | 4/1991 | Kennedy | 42/71.01 |
| 5,907,918 A | | 6/1999 | Langevin et al. | |
| 5,979,098 A | | 11/1999 | Griggs | |
| 6,250,009 B1 | * | 6/2001 | Leontuk | 42/72 |

* cited by examiner

*Primary Examiner*—Michael J. Carone
*Assistant Examiner*—M. Thomson
(74) *Attorney, Agent, or Firm*—Chad M. Hinrichs; Doernerner, Saunders, Daniel & Anderson

(57) ABSTRACT

A butt stock for a tactical weapon, rifle, shotgun or other firearm. The butt stock has a butt plate with two or more surfaces. One of those surfaces is generally perpendicular to the direction of the firearm. The other surface is angled to provide a more stable shooting platform for the firearm as well as a more comfortable use of the firearm in a tactical shooting position.

4 Claims, 3 Drawing Sheets

TACTICAL DUO STOCK

BACKGROUND OF THE INVENTION

1. Field of the Invention

This invention relates to stocks for firearms. More particularly, to the butt stock of firearms used for tactical or combat situations.

2. Prior Art

Most modern firearms have a stock which is designed for shooting the firearm in a classical shooting position. In the classical shooting position, the butt stock is placed in the shoulder pocket of the shooter. The shooter's shoulders and feet are at approximately a 30° angle to the direction of the firearm and the shooter's head is lowered and forward such that his cheek is firmly on the top of the butt stock and the shooter's dominant eye is aligned with the firearm's sights.

Use of the classical shooting position while in a tactical or close quarter battle (CQB) situation exposes the shooter to additional risk. In a tactical situation, a shooter typically wears body armor which protects the front and back of the torso of the shooter. However, it does not protect the arms of the shooter and, as such, if the shooter is confronting a threat in the classical shooting position the firearm will typically be pointed towards the threat, the shooter will be standing at a 30° angle to the direction of the firearm, and as such a 60° angle to the threat. This exposes the opening in the body armor where the non-dominant arm goes through the body armor. Upper torso wounds from small arms fire in combat can enter through this opening.

Due to this draw back in the classical shooting position, the tactical shooting position is preferred in a CQB situation. In the tactical shooting position, the shooter stands so that his shoulders and feet are perpendicular to the direction of the firearm. The bottom corner of the butt stock is placed against the shooter's dominant side, mid-clavicle region, while the shooter's head is upright and looking forward. The firearm is carried in the ready position until a threat is confronted. In the ready position, the firearm is pointed downward at a 45° angle towards the ground. Once a threat is confronted, the firearm is raised and pointed toward the threat, and the shooters shoulders and feet are maintained at a perpendicular orientation to the direction of the firearm. With the firearm in the tactical shooting position, the top of the butt stock is against the shooter's dominant side cheek and the shooter's dominant eye is in line with the sights. The tactical shooting position provides the shooter with an optimal amount of protection from their body armor. It also provides the shooter with a better vision for additional threats coming from the non-dominant side of the shooter.

The problem with using the tactical shooting position with the firearm stocks on the market today is that the only point of contact between the firearm and the shooter's torso is the lower corner of the butt stock. This decreases the stability of the firearm and shooter. Another drawback is that this small pointed area of the firearm is placed directly upon the clavicle of the shooter; therefore, any recoil from the firearm is forced into a very small area on the shooter. This increases the discomfort and stiffness of the shooter resulting from this recoil.

Many sporting firearms such as shotguns have a stock where the butt stock is offset at an angle from the barrel. This helps lower the butt plate of the stock so that when shooting in a classical shooting position the butt plate reaches down to the shoulder pocket of the shooter while the sights remain in front of the shooter's dominant eye. Use of an offset angle is helpful when shooting in the classical or tactical shooting position. However, if the shooter must move to a prone shooting position, the use of a stock with a large offset angle causes the shooter to have to raise their head to a higher level in order to place their dominant eye in line with the sights of the firearm. In a CQB situation, this exposes the shooter to additional risk due to the fact that their head is raised.

There are numerous patents for firearm stocks with an adjustable butt stock which allows the shooter to adjust the offset angle. These patents include U.S. Pat. No. 146,651 entitled "Stocks for Fire-Arms" issued to A. R. Byrkit on Jan. 20, 1874; U.S. Pat. No. 843,227 entitled "Jointed Gun Stock" issued to Homer W. Munson on Feb. 5, 1907; U.S. Pat. No. 855,229 entitled "Gun Stock" issued to Patrick H. Clarisey on May 28, 1907; U.S. Pat. No. 1,088,362 entitled "Adjustable Butt Plate for Gun Stocks" issued to John W. Perkins on Feb. 24, 1914; U.S. Pat. No. 1,582,395 entitled "Butt Cap for Guns, Especially for Short Rifles" issued to Rudolf Haemmerli on Apr. 27, 1926; U.S. Pat. No. 1,651,299 entitled "Adjustable Gun Stock" issued to Roy V. Stansel on Nov. 29, 1927; and U.S. Pat. No. 5,779,098 entitled "Recoil Absorber and Redirector Mechanism for Gun Stock" issued to Jay P. Griggs on Nov. 9, 1999. However, these devices require that the shooter adjust the stock to one setting for a classical or tactical shooting position. They must then readjust the stock again for a prone shooting position. In a combat situation, the shooter must rapidly move from one firing position to another. This may entail changing from a tactical shooting position to a prone shooting position or vice versa. As such, the shooter does not have time when changing firing positions to adjust or readjust a stock in order to obtain optimum performance from their firearm.

U.S. Pat. No. 694,904 (the '904 patent) entitled "Sighting Device for Firearms" issued to William Youlten on Mar. 4, 1902 discloses an adaptor which can be attached to the butt stock of a rifle. This adaptor allows the shooter to operate the firearm from a trench without exposing their head above ground level. The device disclosed in the '904 patent places the firearm above the shooter's head while in use. This differs greatly from the present invention which allows the shooter to shoot from either a classical position, a tactical shooting position or a prone position. The device disclosed in the '904 patent is only useful for firing from a trench and cannot be used for shooting from a classical, tactical or prone shooting position.

SUMMARY OF THE INVENTION

Due to the shortcomings of the prior art, it is an objective of the present invention to provide an improved firearm butt stock which can readily be used in a classic shooting position, a tactical shooting position, and a prone shooting position without readjustment of the stock.

Another objective of the present invention to provide an improved firearm butt stock which has a butt plate with two or more surfaces where one surface is used for shooting from the classical shooting position or the prone position and another one of the surfaces is tailored to provide a more comfortable and stable use of the tactical shooting position.

It is a further objective of the present invention to provide an improved firearm butt stock which has a butt plate with two or more surfaces and that one of those surfaces is adjustable to provide a custom fit of the firearm stock when firing from the tactical shooting position.

Yet another objective of the present invention is to provide a collapsible stock with a butt plate with two or more surfaces. One of those surfaces is used for shooting from the classical shooting position or the prone position and another one of these surfaces of the tactical shooting position. Other objectives, advantages and features of the present invention will be apparent to those skilled in the art following a review of the specifications, drawings and claims of this patent.

DETAILED DESCRIPTION OF THE PREFERRED EMBODIMENT

Figure 1:
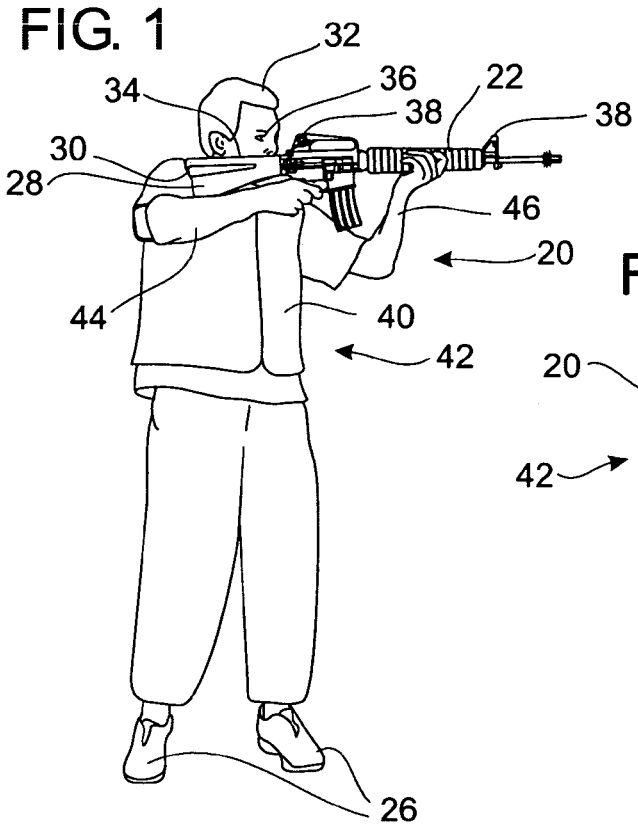
FIG. 1: A side view of a shooter using the classic shooting position.
Figure 2:
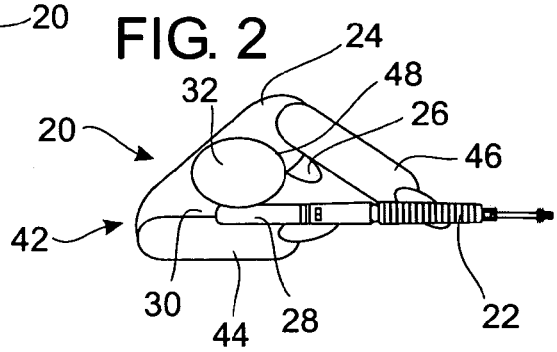
FIG. 2: A top view of a shooter using the classic shooting position.

FIG. 1 shows a side view of a shooter 20 holding a firearm 22 in a classical shooting position. FIG. 2 is a top view of a shooter 20 holding a firearm 22 in a classical shooting position. In the classical shooting position, the shoulders 24 and feet 26 of the shooter 20 are at approximately 30 degrees angle to the direction of the firearm 22. The butt stock 28 of the firearm 22 is held firmly against the shoulder pocket 30 of the shooter 20. The head 32 of the shooter 20 is leaned forward so that the cheek 34 of the shooter 20 is firmly against the top of the butt stock 28 of the firearm 22, thus forming a cheek weld between the cheek 34 and the butt stock 28 of the firearm 22. The dominant eye 36 of the shooter 20 is in line with the sights 38.

The classical shooting position provides a stable platform from which to shoot. It is well suited for hunting, target shooting and other non-tactical situations; however, it is not the preferred shooting position for tactical or close quarters battle (CQB) situations. The body armor 40 typically used in tactical situations protects the front and back of the shooter's torso 42. However, the body armor 40 does not protect the dominant or non-dominant arm 44 or 46 of the shooter 20. This means that if the shooter 20 uses the classic shooting position in a tactical situation, the shooter is increasing his risk of bodily injury by exposing to the threat the unprotected area where the shooter's 20 non-dominant arm 46 attaches to the shooter's 20 torso 42.

The classical shooting position also has the shortcoming in a tactical situation of limited visibility towards the shooter's 20 non-dominant side. While shooting in the classical shooting position the shooter's 20 non-dominant eye 48 typically is closed, also the shooter's torso 42 is turned away from the shooter's non-dominant side. Both of these factors make it difficult for the shooter 20 to detect and confront a threat coming from the shooter's 20 non-dominant side.

Figure 3:
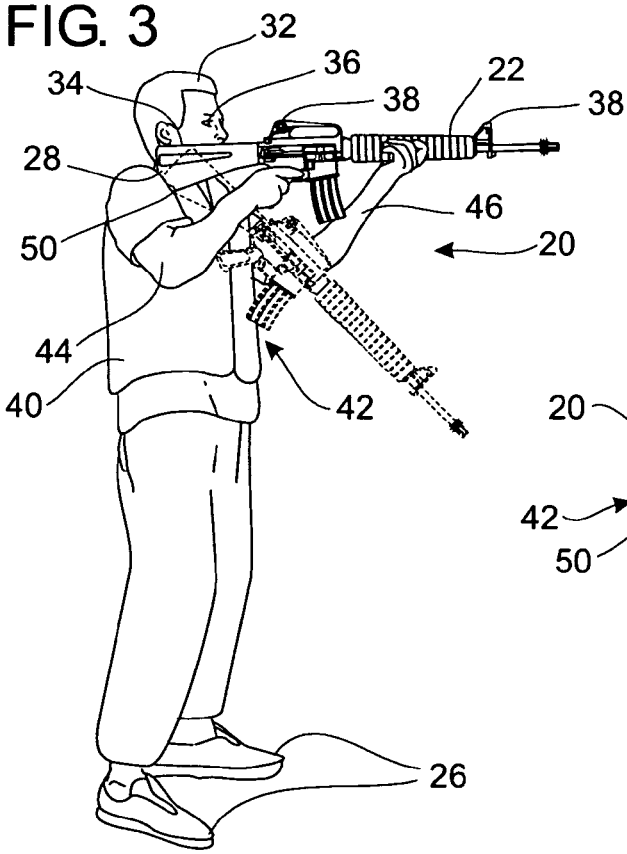
FIG. 3: A side view of a shooter using the tactical shooting position.
Figure 4:
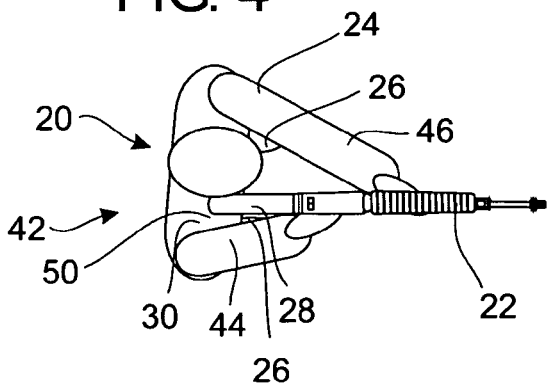
FIG. 4: A top view of a shooter using the tactical shooting position.

FIG. 3 shows a side view of a shooter 20 firing a firearm 22 from a tactical shooting position. FIG. 4 shows a top view of a shooter 20 shooting a firearm 22 from the tactical shooting position. The firearm 22 is held in the ready position shown in dash lines in FIG. 3 until a threat is confronted. In the ready position, the firearm 22 is held at a 45 degree angle pointing toward the ground. The butt stock 28 of the firearm 22 is held against the mid-clavicle region 50. Once the threat is confronted, the firearm 22 is rotated to a position perpendicular to the body of the shooter 20. The firearm 22 is rotated about the point of contact between the butt stock 28 and the mid-clavicle region 50 of the shooter 20. The shoulders 24 and feet 26 of the shooter 20 are perpendicular to the firearm 22. The head 32 of the shooter 20 is in an upright and forward facing position. A cheek weld is established by having the top of the butt stock 28 firmly against the cheek 34 of the shooter 20. The dominant eye 36 of the shooter 20 is in line with the sights 38 of the firearm 22.

As best seen in FIG. 3, the mid-clavicle region 50 of the chest of the shooter 20 is at an angle. Therefore, when the tactical shooting position is used with a firearm 22 with a prior art butt stock 28, only the lower rear corner of the butt stock 28 is resting against the shooter's 20 mid-clavicle 50. When the firearm 22 is fired, this small area of contact must absorb all of the recoil generated by the firearm 22.

It is also important to note the angle of the mid-clavicle region 50 of the chest can vary greatly from individual to individual. This variation and angle is largely due to differences in the development of the pectoralis muscles in the chest of the individual. This angle can typically range from 28° to 44°. The shooter 20 must use this small area of the mid-clavicle region 50 of the chest to steady the firearm 22.

Figure 5:
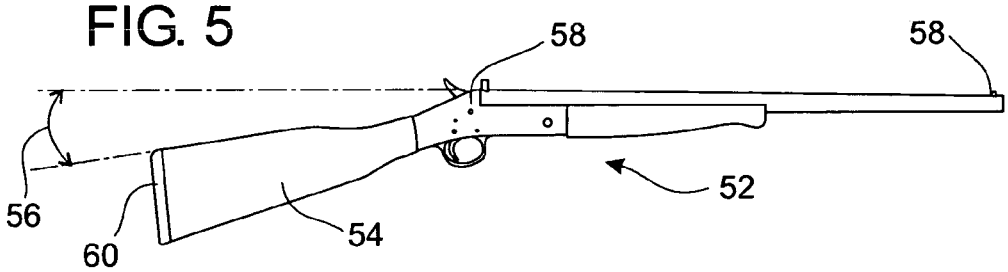
FIG. 5: A side view of a typical shotgun.

Many firearms such as the shotgun 52 shown in FIG. 5 have a stock where the butt stock 54 has an offset angle 56. This helps raise the sights 58 such that when the firearm is shouldered the sight 58 are in front of the shooter's 20 dominate eye 36 while allowing the rear surface of the butt stock or butt plate 60 to be low enough to engage the shoulder of the shooter.

Figure 6:
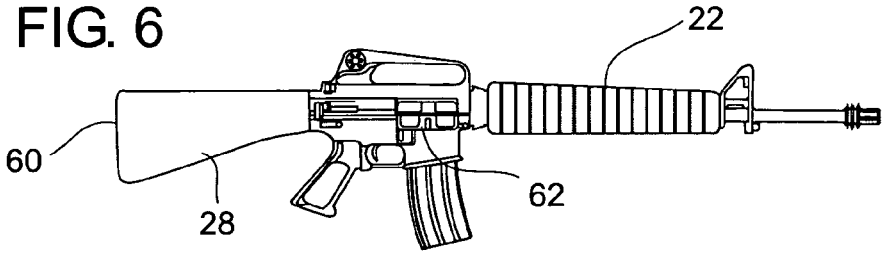
FIG. 6: A side view of a typical rifle.

FIG. 6 shows a firearm 22 typically known as the M16 or AR15. This is the same firearm seen in FIGS. 1 through 4. It should be noted that the butt stock 28 of the firearm 22 does not have a stock offset angle such as the shotgun 52 shown in FIG. 5, rather the butt stock 28 of the firearm 22 extends directly back from the receiver 62.

Figure 7:
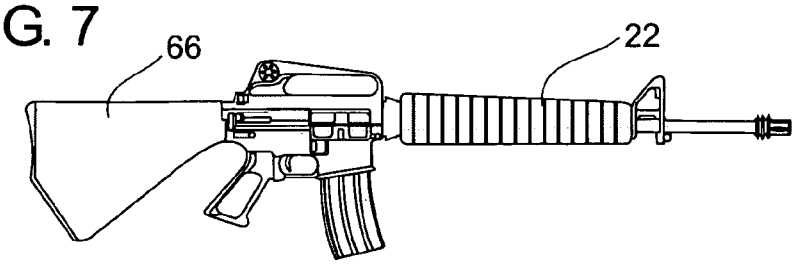
FIG. 7: A side view of a typical rifle equipped with one embodiment of the present invention.
Figure 9:
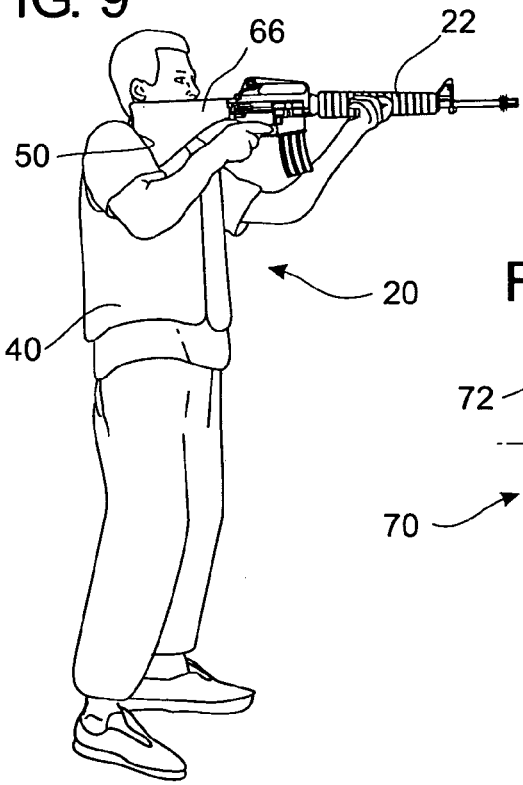
FIG. 9: A side view of a shooter with a rifle equipped with one embodiment of the present invention in the tactical shooting position.
Figure 8:
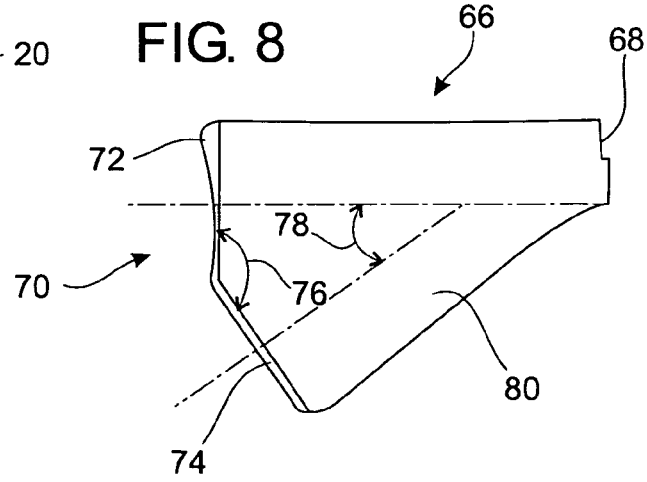
FIG. 8: A side view of one embodiment of the present invention.

FIG. 7 shows a firearm 22 equipped with one embodiment of the present invention, an improved butt stock, the tactical duo stock 66. FIG. 8 is a side view of the embodiment of the duo stock 66 which is shown attached to the firearm 22 in FIG. 7. FIG. 9 shows a shooter 20 holding a firearm 22 in the tactical shooting position. The firearm 22 is equipped with the same embodiment of the tactical duo stock 66 as shown in FIGS. 7 and 8. The forward end 68 of the duo stock 66 is constructed to attach to the firearm 22. It will be apparent to those skilled in the art that the forward end 68 of the duo stock 66 can be adapted to many different forms in order to attach to various different rifles, shotguns, and other firearms. The duo stock 66 also has a butt plate 70. The back end 70 is made up of an upper section 72 and a lower section 74. The butt plate 70 could be comprised of a separate plate attached to the rear of the duo stock 66 or it could be the rear surface of the duo stock 66 without any separate pieces being attached to the duo stock 66. The upper section 72 and/or lower section 74 can be curved or contoured to better fit the shoulder pocket 30 and mid-clavicle region 50 of the shooter 20.

The butt plate angle 76 and the offset angle 78 are shown in FIG. 8. The preferred butt plate angle is 145°, however, this angle could vary from 135° to 155°. Likewise, the preferred offset angle 78 for the duo stock 66 is 35°, however, this could vary from a range of 25° to 45°.

While in the tactical shooting position as shown in FIG. 9, the lower section 74 of the butt plate 70 rests against the mid-clavicle region 50 of the shooter 20. Because the surface of the lower section 74 is generally parallel with the mid-clavicle region 50 of the shooter 20, any force from the recoil of the firearm 22 is spread across the area directly underneath the lower section 74. This is an improvement over the prior art butt stock 28, as shown in FIGS. 1–4 and 6. When that butt stock 28 is used in the tactical shooting position, the force from the recoil of the firearm 22 is directed through the lower corner of the butt stock 28 and against a much smaller area of the mid-clavicle region 50 of the shooter 20. This increased area of impact created by use of the tactical duo stock 66 helps soften the impact of the recoil allowing for faster follow up shots as well as reduced soreness and stiffness of the shooter 20.

This increased area of contact between the firearm 22 and the shooter 20, due to the use of the duo stock 66 also provides a more stable shooting platform. This in turn increases the comfort, speed, and accuracy of the shooter 20's performance.

Figure 10:
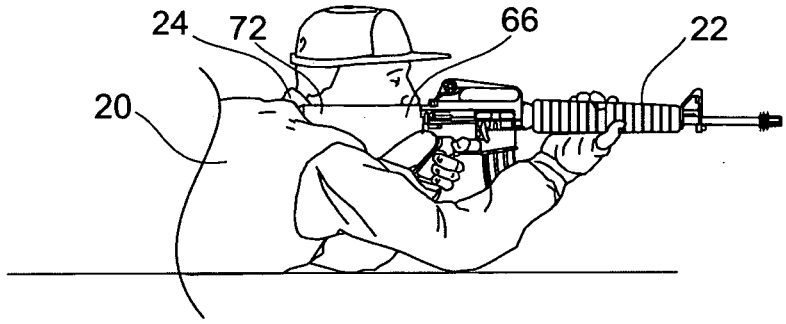
FIG. 10: A side view of a shooter with a rifle equipped with one embodiment of the present invention in the prone shooting position.

FIG. 10 shows a shooter 20 holding a firearm 22 in a prone position. The firearm 22 is equipped with a tactical duo stock 66. In the prone position, the upper section 72 of the duo stock 66 rests against the shoulder of the shooter 20 as with any conventional stock.

Figure 11:
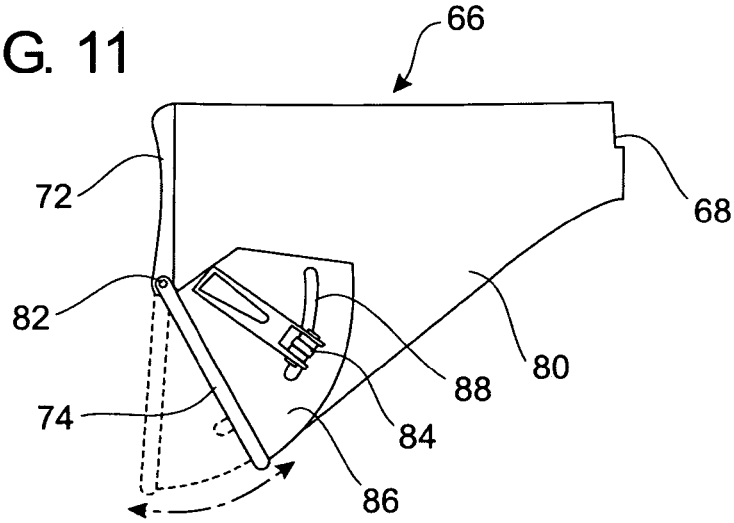
FIG. 11: A side view of one embodiment of the present invention.

FIG. 11 shows a second embodiment of the tactical duo stock 66. In the second embodiment, the duo stock 66 has an adjustable lower section 74. The lower section 74 is pivotally attached to the upper section 72 and/or the body 80 of the duo stock. As shown in FIG. 11, there is a hinge 82 which creates the pivotal attachment for the lower section 74. With the adjustable lower section 74, the butt plate angle 76 can be adjusted to fit the angle of the mid-clavicle region 50 of the individual shooter 20. This means a better fit for the shooter 20 while using the duo stock 66 in a tactical shooting position.

Once the butt plate angle 76 has been adjusted to fit the individual shooter 20, it can be used like the other embodiments of the duo stock 66, allowing the shooter 20 to move from a prone or classical shooting position to a tactical shooting position, or vice versa, without readjusting the butt plate angle 76.

The adjustable lower section 74 has a plate 86 which is attached to it. The plate 86 runs alongside the body 80. There is a slot 88 in the plate 86 through which the lock 84 passes. The adjustable lower section 74 is held in place relative to the upper section 72 and the body 80 by the lock 84 holding the plate 86 in place. The embodiment shown in FIG. 11 uses a cammed lock, however, those skilled in the art could adapt the present invention to use any of a number of locks known in the art.

Figure 12:
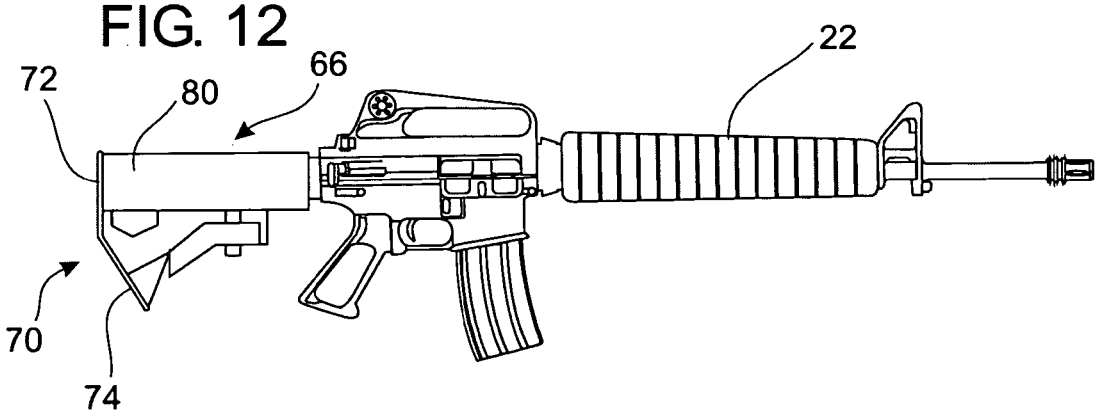
FIG. 12: A side view of a rifle equipped with one embodiment of the present invention.

FIG. 12 shows a firearm 22 equipped with a collapsible stock well known in the art. The collapsible stock is equipped with the duo stock 66. The butt plate 70 of the collapsible stock has the upper section 72 and a lower section 74 at an angle to the upper section 72. The present invention works the same with the collapsible stock as it does with the other embodiments of the invention. It should be noted that the embodiment of the present invention shown in FIG. 12 could be adapted to incorporate the adjustable butt plate feature shown in FIG. 11.

The foregoing specifications and drawings are only illustrative of the preferred embodiments of the present invention. They should not be interpreted as limiting the scope of the attached claims. Those skilled in the arts will be able to come up with equivalent embodiments of the present invention without departing from the spirit and scope thereof.

What is claimed is:

1. An improved butt stock comprising:

a body having a top, a bottom, a front end, a back surface, a left side, a right side;

a butt plate forming the back surface of the body;

the butt plate comprising at least a first and a second surface, the first surface being generally vertical and the second surface being at an angle to the first surface wherein the second section is angled toward the front end of the body at an angle within the range of 135 to 155 degrees.

2. An improved butt stock as claimed in claim 1, wherein the angle between the first surface of the butt plate and the second surface of the butt plate is 145°.

3. An improved butt stock as claimed in claim 1, further comprising an offset angle of the second surface of the butt plate within the range of 25 degrees to 45 degrees.

4. An improved butt stock as claimed in claim 1, further comprising an offset angle of the second surface of the butt plate at 35°.

* * * * *